United States Patent [19]

Giannetti

[11] 4,048,489

[45] Sept. 13, 1977

[54] LIGHT OPERATED TARGET SHOOTING SYSTEMS

[76] Inventor: Carlo Giannetti, 541 Dorothy Drive, Fullerton, Calif. 92631

[21] Appl. No.: 630,091

[22] Filed: Nov. 10, 1975

[51] Int. Cl.[2] ..... F41G 3/26; F41F 27/00

[52] U.S. Cl. ..... 240/6.41; 35/25; 42/1 A; 273/101.1

[58] Field of Search ..... 240/6.41, 10.62; 273/101.1; 35/25; 42/1 A

[56] References Cited

U.S. PATENT DOCUMENTS

| | | | |
|---|---|---|---|
| 3,633,285 | 1/1972 | Sensney | 35/25 |
| 3,792,535 | 2/1974 | Marshall et al. | 35/25 |

*Primary Examiner*—George H. Miller, Jr.
*Assistant Examiner*—M. L. Gellner
*Attorney, Agent, or Firm*—Grover A. Frater

[57] ABSTRACT

An electro-optic light pulse generator is completely contained in a gun sight holder and serves as the light source in any light responsive target shooting system. The gun sight holder is arranged for mounting on any long barrelled gun without need for modification of the gun so that its utility for shooting regular ammunition is not disturbed. The pulse generator is a laser or other light emitting unit, mounted with an optical system, electronic controls, and a battery power source in the interior of the unit. When the user "shoots" the gun, light pulses are beamed in the direction that the gun and its sight holder are pointed. The resolution of the system and its range are such as to warrant use with a telescopic sight and in one form of the invention, the gun sight holder is a telescope mount. The recoil of the gun or an action simulating recoil, is used to trigger emission of the light beam.

13 Claims, 10 Drawing Figures

LIGHT OPERATED TARGET SHOOTING SYSTEMS

BACKGROUND

This invention relates to improvements in target shooting systems and in apparatus for such systems. The danger and expense involved in the use of live ammunition while conducting practice sessions and competition in markmanship has prompted the development of systems in which light rays, rather than bullets, are "shot" at the target. This invention relates to improvements in systems of that kind and apparatus for such systems.

The targets that are used in light systems are relatively simple. They employ any of a number of the electro-optic devices that convert light to electricity or which experience a change that can be detected electrically. In most cases, the target is the light receiving element of the system. The light sending apparatus is associated with the gun and its design presents a more difficult problem because different applications for such systems impose different requirements for realism. In some applications, it is desirable that the user experience a recoil as an incident to shooting the light source gun. For such applications, the gun trigger can be made to actuate a solenoid plunger housed within the gun or to discharge a quantity of air in the case of an air gun. Both of those expedients will produce a recoil without need to discharge a bullet or missile. Most air operated guns will require no modification to produce a recoil, but, of course, a special gun or modification is required if the recoil is to be reproduced electromagnetically.

When the purpose is merely to develop or to demonstrate markmanship, recoil is not required. In that case and in the case of the air operated gun, there would be no need to make a special gun if the light pulse generator was arranged so that it could be used with any one. Prior art light operated target systems generally require a special gun. This invention makes it possible to use an existing gun without modification and it is an object of the invention to provide that result. The advantage of having a light operated target system that is universal in application is lost if the system is so cumbersome or complex that the cost and difficulty of operation approaches that of the systems that require special guns. Another object of the invention is to provide a light operated target system and apparatus therefor which is equally applicable to standard fire arms, air operated guns, and guns that are special in the sense that they have recoil mechanisms built into them. A removable gun sight holder and light generator of that kind has not been available heretofore.

While the invention could be applied to hand guns, it is particularly suited to use with long barrelled guns and particularly to rifles and to guns that resemble rifles. Telescopic sights are often used with such guns and one of the objects of the invention is to provide a light operated target system and apparatus therefore which is entirely compatible with use of a telescope as the gun sight.

SUMMARY OF THE INVENTION

In the invention, the light source is housed in a gun sight holder. Most rifles and many air operated guns are manufactured with conformations at the rear of the barrel at the top of the gun in which standard gun sight mounting brackets are received. Those conformations will receive telescope mounting structures which are standard in the sense that they are arranged to fit in the standard gun sight slots. The preferred form of the invention uses a solid state laser. Except that the range is shorter, the invention can successfully employ a light emitting diode. The current state of light emitting diode development makes it possible to produce light source at reasonable cost which is useful at a range of about 400 feet. The current state of laser development extends the range to about 800 feet, even in bright sunshine.

The invention permits the gun sight holder to be used for that purpose, and one of the advantages of the invention is that it is entirely compatible with a gun and telescope combination. The holder is formed with a cavity that houses batteries and the electrical and electronic circuitry required to excite the solid state light source to produce a burst, or pulse, of light. The light pulse is generated in response to a signal initiated by a switch that is built into the mount. In preferred form, the switch is one that may be actuated either manually or in response to recoil of the gun.

A major advantage of the light system relative to the actual shooting of bullets is its safety. Neither the intensity of the light nor the magnitude of the power employed in its generation poses any safety hazard. While safety is a more important consideration than its cost, nonetheless, the cost is an important factor. The invention provides a highly reliable and highly accurate light source at relatively low cost, and to do that is another object of the invention. Because it employs a self-contained, removeable gun sight holder, the expense of special guns may be avoided.

Other objects and advantages of the invention will become apparent upon examination of the specification that follows and the accompanying drawings. In this connection, it is to be understood that the invention is not limited to the embodiments illustrated in those drawings, but is limited only by the scope of the appended claims.

DRAWINGS

Figures 1, 2, 3, 4, 5, 6, 7, 8, 9, 10:
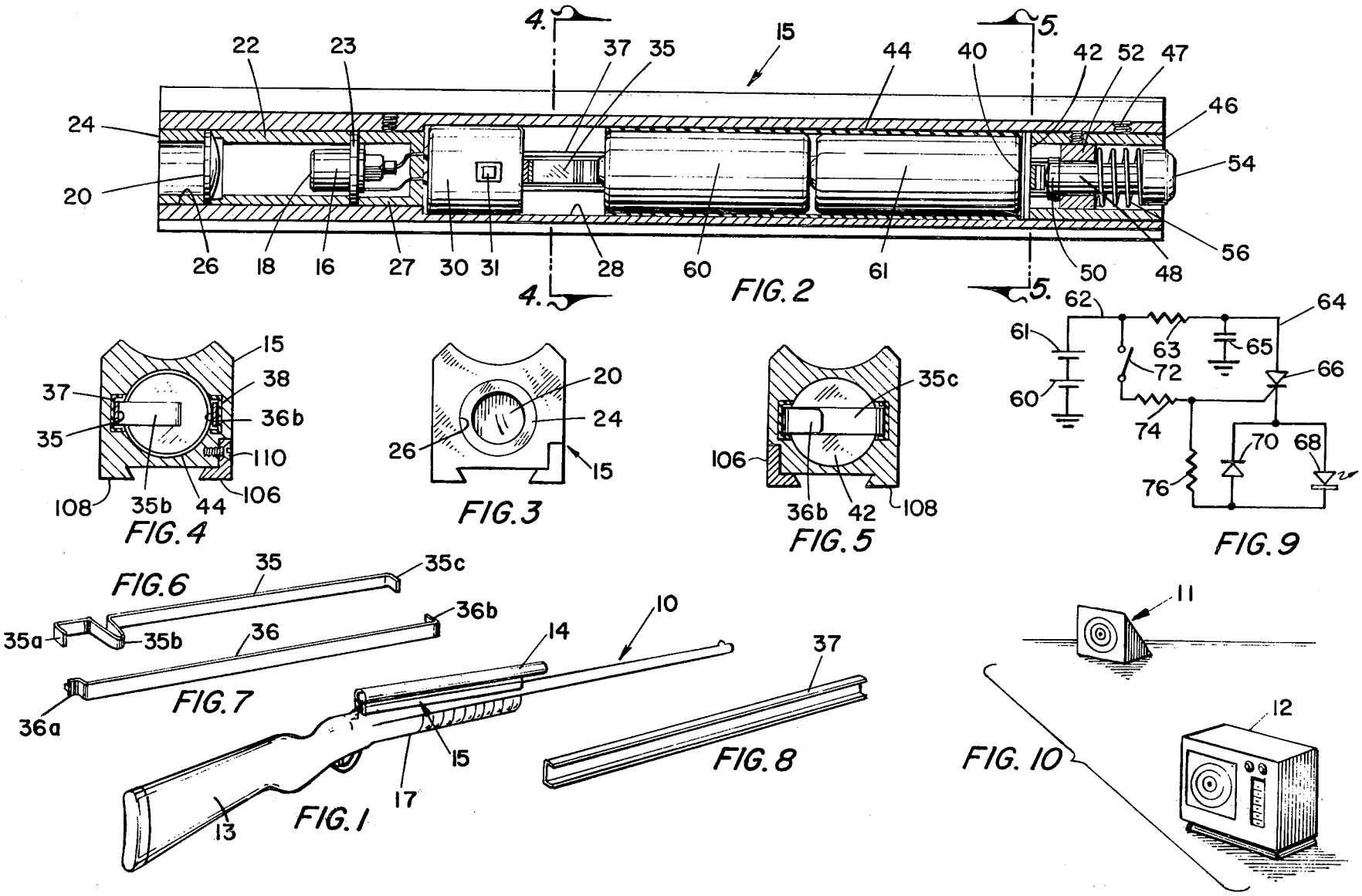
FIG. 1 is a perspective view of an optical gun in which the invention is embodied.
FIG. 2 is a cross-sectional view of a light pulse generating system housed in a telescope mount taken on the longitudinal vertical section through the mount.
FIG. 3 is a view in elevation of the forward end of the mount.
FIG. 4 is a cross-sectional view taken on line 4—4 of FIG. 2.
FIG. 5 is a cross-sectional view taken on line 5—5 of FIG. 2.
FIG. 6 is a perspective view of a conductor strip that forms part of the light pulse generating system.
FIG. 7 is a perspective view of another conductor strip.
FIG. 8 is a perspective view of an insulator strip.
FIG. 9 is a circuit diagram of the electronic portion of the light transmitting unit.
FIG. 10 is a pictorial representation of a target and score display unit suitable for combination with the gun of FIG. 1 to form a gun and target system.

In FIG. 1 the numeral 10 generally designates a gun which transmits light pulses rather than bullets. In the system shown, it is assumed that the shooter will direct those light pulses toward the target structure 11 of FIG. 10. The target includes light sensors spaced over its target surface. Those sensors provide electrical signals or a change in an electrically sensed circuit perameter. The signals are used to actuate a scoring device. Any of many scoring schemes are suitable. In this particular embodiment, the scoring unit is housed in a display cabinet 12 which is electrically connected to the target 11. The display cabinet includes an enlarged reproduction of the target. That display target is lighted at the point at which light pulses from the gun 10 fall upon the target 11.

The invention does not depend upon any particular kind of gun configuration. In this particular case, the gun comprises a rifle 13, a telescopic sight 14, and a telescope holder 15. This rifle is a conventional target rifle. The gun shown does not include any recoil simulator, although such a simulator can be attached to it. Thus, for example, the forward part of the stock, the forward hand grip 17, can be removed and replaced with one that includes a solanoid and battery and means for connecting them to the trigger structure. However, the specific structural arrangement of the recoil mechanism does not form part of the invention, and, indeed, utility of the invention is not limited to the use of guns with recoil mechanisms or recoil simulators.

The fact that the gun 10 is fitted with a telescope suggests that the light pulse generating and transmitting structure is capable of a resolution that warrants use of a telescope. In fact, one of the advantages of the invention is that it can be used as a substitute for live ammunition in a serious training or competitive exercise involving telescopes. On the other hand, the telescope can be omitted and the upper surface of the telescope mount can be used as an ordinary sight.

The invention is not limited to any particular physical size except that the size usually will be related to the size or readily available batteries. The gun sight shown in FIGS. 2 through 5 is approximately 1 inch wide, 1 inch high, and 5¼ inches long. The axial bore through the sight is approximately ⅜ of an inch in diameter in its forward section and approximately 9/16 of an inch in diameter throughout the remainder of its length. The optical system is housed in the forward, smaller diameter bore. That optical system comprises a light generator 16 which includes a lens 18 at the point at which light emerges from the housing. The optical system is completed by a lens 20 which is located forwardly of lens 18. The spacing between the two lenses is fixed by a cylindrical spacer 22 which extends from the forward face of the mounting disc 23 for the light generator 16 to the rear face of the lens 20. The lens is fixed in place in the bore by forward cylindrical bushing 24. Both the cylindrical spacer 22 and the bushing 24 are press-fitted into the forward part of the bore, which, for identification has been given the reference numeral 26. The rearward, or enlarged, portion of the bore is identified by the reference numeral 28. The light generator 16 is housed in a separate housing which is fixed to disc 23. Lead wires connect laser, or generator 16, to terminals at the bottom of a cup-shaped spacer 27 and then to terminals at the forward end of the housing 30 which contains the several components, other than the initiating switch, of an electrical circuit which excites the light generator and causes it to emit light pulses.

In addition to the above described connections between the light generator 16 and that electronic package housing 30, there are electrical connection elements on the rear and side surface of the package of which connnection is made to the battery power source and to an initiating switch. In FIG. 3, there are two contacts, 31 and 33, which are exposed at one side and at the rear of the housing 30, respectively. When the unit is completely assembled those contacts engage portions of conductor strips shown in FIGS. 6 and 7. The strips are inserted from the rearward end of the telescope holder. One is designated 35 and the other 36. Each is carried in an insulating channel. The channels are alike. Channel 37 carries strip 35; channel 38 carries strip 36.

Strip 35 is formed with three offset portions 35*a,* 35*b* and 35*c.* Portion 35*a* engages rear contact 33 of electronic package 30. Offset 35*b* engages the positive terminal of a pair of dry cell batteries arranged end to end in series to provide a total of 45 volts. The negative connection to the battery pack is completed to the metal of the mount 15 through a metal disc 40, the sides of which are notched (not shown) to clear the conductor strips 35 and 36 which pass the metal disc 40 and an insulating disc 42 which overlies the metal disc.

Offset portion 35*c* of conductive strip 35 is stepped to provide a part next to the body of the strip which cooperates with portion 35*b* to clamp the batteries together. The other part of portion 35*c* serves as the moveable contact of a normally open switch whose other contact is formed by portion 36*b* of conductive strip 36. Strip portion 36*b* lies flat against insulating disc 42. Its other end 36*a* is shaped to engage and to hook into connector 31 at the side of the electronic package.

To assemble the unit, the plastic insulating channels 37 and 38 are slipped into grooves in the side walls of the bore 28. The two batteries are installed in an insulating sheath 44 and the conductor strips are placed along the sides of sheath after the discs 40 and 42 are placed over the negative end of the battery set. The terminal 36*a* is hooked onto terminal 31 of the electronic package 30. That whole sub-assembly is inserted in bore 28 and pushed in until package 30 engages the shoulder that separates bore 28 from the smaller bore 26.

The sub-assembly thus described is held in place by a switch actuator assembly which includes a sleeve 46. The sleeve has an outer diameter just less than the inner diameter of bore 28. Its forward end is notched to clear the two conductive strips, but elsewhere engages disc 42 at its forward rim. The sleeve is held in place by a set screw 47.

The switch actuator is a cylindrical rod 48 having an enlarged insulating head 50 which engages the moveable contact 35*c.* The rod extends through a bushing 52 which is positioned inside sleeve 46 and is coaxial with it. A button head 54 is formed on the opposite end of rod 48. Part of the head is disposed in sleeve 46 where it has a sliding fit. Part of the head extends from the sleeve so that it can be pushed to move the rod and actuator 50.

That movement results in forcing portion 35*c* of conductor strip 35 into engagement with portion 36*b* of conductor strip 36 to close the switch. A light compression spring 56 urges the button 54 outwardly to switch open position. So does portion 35*c* of strip 35. It exhibits resilient bias to move it away from portion 36*b* when the switch actuator is released. The other spring 56 is trapped between bushing 52 and operating button 54. It insures that the actuator 50 is fully retracted to bushing 52.

The need to bring conductors from the electronic package 30 to the rear portion of the gun sight, and the need for the conductor strips 35 and 36 in this embodiment, stems from the fact that the switch is located electrically in a circuit that extends to the positive terminal of the power source and must be isolated from electrical ground. The preferred circuit is shown in FIG. 9. Batteries 60 and 61 are connected in series. Beginning at the positive terminal, the circuit proceeds through line 62 and a current limiting resistor 63 to a junction point in a line 64. A charging capacitor 65 is connected from line 64 ground connects to the negative terminal of battery 60. Line 64 continues to the positive side of a silicon controlled rectifier 66 whose output is connected to ground through the parallel combination of a laser diode 68 and a reverse connected diode 70. The switch 72 in FIG. 9 is formed by portions 35*c* of the conductor strips as described above. The switch is connected in a series circuit beginning at conductor 62 (the positive terminal of the battery pack) and extending through switch 72, a resistor 74, and a resistor 76 to ground in that order. The control element of silicon controlled rectifier 66 is connected to the junction between the two resistors 74 and 76.

The circuit uses so little power that it is not necessary to provide a shut-off switch in the supply lines from the battery. The current flows through the battery and the current limiting resistor 63 to charge capacitor 65. Switch 72 is normally open and the silicon controlled rectifier 66 is normally non-conducting so that no additional current flows after the capacitor 65 becomes fully charged. Upon closure of the switch 72, the circuit is completed from the line 62 in the positive terminal in the battery pack through the voltage divider comprising resistor 74 and 76 to ground. A portion of that voltage is applied to the control electrode of the silicon controlled rectifier 66, and that rectifier is rendered conductive. The charge stored in the capacitor 65 is immediately discharged through the silicon controlled rectifier 66 through the lazer 68 to ground. The current path has very low resistance so that a very large current flows through the lazer 68 for a short period of time. During that time, the lazer emits a beam of light. The diode 70 is simply a protective device to protect the laser and the silicon controlled rectifier from excessive transient signals.

The laser emits a light in a predetermined direction, and it is oriented in its housing 16 so that that light is emitted through the lens system comprising lenses 18, if used, and lens 20. The combination of the laser with its directional characteristics and the lens system serves to direct light in a very small diameter beam in the direction of their common axis.

There are other possible circuit arrangements which place the initiating switch in the line from one of the battery terminals. The arrangement shown has the advantage that the metal body of the telescopic mount is used as a ground line. In some circuit configurations, to employ the case as the electrical ground, it is necessary only to operate a switch to complete a connection from either the negative or the positive terminal of the battery pack to the metal housing. However, in this embodiment, the switch terminals are both "above" the electrical ground and the conductor strips are required.

Returning to FIG. 2, rod 48 and its push button head 54 of the switch actuator are formed of metal and have enough mass so that they exhibit inertia sufficient to actuate the switch contacts 35*c* and 36*b* when the gun recoils. If the gun includes no recoil simulator, then it is simply fired by depressing the switch operating button 54. Ordinarily, that button is pressed in the same hand motion that includes squeezing of the trigger so that the action applied to a real firearm is simulated, even though the recoil is lacking.

The arrangement for clamping the telescope holder to the gun is best shown in FIGS. 3, 4 and 5. A clamping strip 106 extends the full length of the holder. The lower edge of the holder is cut away to receive one side of the clamping strip which is L-shaped in cross-section. One arm, or side, of the L fits in the cut away portion of the holder and the other is disposed below the holder. The inner face of the lower side of the clamping strip slopes downwardly and inwardly toward the central plane of the holder and gun. The holder is formed with a similarily sloped downwardly extending rib 108 at its lower edge opposite the cut away edge. The result is a trapozoidally shaped recess in the assembled holder. The widest side of the trapozoid is at the bottom of the recess. A number of machine screws, such as screw 110, secure the clamping strip to the holder. An upwardly extending trapozoidally shaped member on the upper side of the gun barrel fits in the recess and it has dimensions such that the telescope holder is clamped to it when the clamping strip is tightened to the assembly by tightening the screws 110.

Although I have shown and described certain specific embodiments of my invention, I am fully aware that many modifications thereof are possible. My invention, therefore, is not to be restricted except insofar as necessitated by the prior art.

I claim:

1. A light source for use with a gun in a light responsive target shooting system, comprising:
   - a switch;
   - a light emitting semi-conductor and operating means for causing said light emitting semi-conductor to discharge a light beam pulse as an incident to closure of said switch;
   - means for fixing said light emitting semi-conductor to the upper side of the barrel of the gun such that said light beam pulse is directed in a direction corresponding to that in which said gun is pointed; and
   - means for closing said switch in response to a movement of said gun corresponding to recoil movement.

2. The invention defined in claim 1 in which said means for fixing said light emitting semi-conductor to said gun comprises a gun sight holder.

3. The invention defined in claim 2 in which said gun sight holder comprises an elongated member having a central bore;
   - said light emitting semi-conductor being mounted in said central bore;
   - said operating means comprising a battery, a capacitor, means for charging a capacitor from said battery and an electric switching element for discharging said capacitor through said light emitting semi-conductor as an incident to operation of said switch;
   - said operating means and said battery being disposed in said bore rearwardly of said light emitting semi-conductor.

4. The invention defined in claim 3 which further comprises an optical lens disposed in said bore forwardly of said light emitting semi-conductor.

5. The invention defined in claim 4 in which said means for closing said switch comprises a weight moveable longitudinally in said bore, means in the form of an electrical contact for closing a circuit in said operating means as an incident to displacement of said weight, and means for biasing said weight against such displacement.

6. The invention defined in claim 5 which further comprises means for displacing said weight manually.

7. The invention defined in claim 6 in which said light emitting semi-conductor comprises a laser.

8. A light source for use with a gun in a light responsive target shooting system, comprising:

a switch;

a laser;

operating means for causing said laser to discharge a light beam pulse as an incident to closure of said switch;

means comprising a telescope mount for fixing said laser to said gun such that said light beam pulse is directed in a direction corresponding to that in which said gun, with its telescope mount, is pointed.

9. The invention defined in claim 8 in which said telescope mount comprises an elongated member having a central bore;

said laser being mounted in said central bore;

said operating means comprising a battery, a capacitor, means for charging the capacitor from said battery, and means in the form of an electronic switching element for discharging said capacitor through said laser as an incident to operation of said switch;

said operating means and said battery being disposed in said bore rearwardly of said laser.

10. A light source for use with a gun in a light responsive target shooting system, comprising:

a switch;

a laser;

operating means for causing said laser to discharge a light beam pulse as an incident to closure of said switch;

means comprising a telescope mount for fixing said laser to said gun such that said light beam pulse is directed in a direction corresponding to that in which said gun, with its telescope mount, is pointed;

said telescope mount comprising an elongated member having a central bore;

said laser being mounted in said central bore of the member;

said operating means comprising a battery, a capacitor, means for charging the capacitor from said battery, and means in the form of an electronic switching element for discharging said capacitor through said laser as an incident to operation of said switch;

said operating means and said battery being disposed in said bore rearwardly of said laser;

an optical lens disposed in said bore forwardly of said laser;

said switch comprising a weight movable longitudinally in said bore and means in the form of an electrical contact for closing a circuit in said operating means as an incident to displacement of said weight, and means for biasing said weight against such displacement.

11. The invention defined in claim 10 which further comprises means for displacing said weight manually.

12. In a target shooting system, in combination:

a gun having a barrel;

a gun sight holder mounted on said gun and extending along said barrel from a forward end to a rearward end;

said gun sight holder being formed with an inner cavity and a bore extending from said cavity substantially in the direction of said bore and opening at said forward end;

means within said cavity for generating a pulse of beamed light in response to a control signal and directing said pulse of beamed light through said bore to emerge in a direction substantially parallel with the axis of said barrel; and means for developing said control signal.

13. The invention defined in claim 12 in which said means for developing said control signal comprises a switch.

* * * * *